United States Patent [19]

Robben et al.

[11] 4,451,958

[45] Jun. 5, 1984

[54] SEAT BELT BUCKLE WITH PIVOTING LATCH

[75] Inventors: Paul J. Robben, Kermt-Hasselt; Raymond Legros, Brussels, both of Belgium; Udo Rittersdorf, Stockelsdorf, Fed. Rep. of Germany

[73] Assignee: Allied Corporation, Morris Township, Morris County, N.J.

[21] Appl. No.: 399,399

[22] Filed: Jul. 19, 1982

[30] Foreign Application Priority Data

Jul. 27, 1981 [FR] France ..... 81 14566

[51] Int. Cl.[3] ..... A44B 11/28; A44B 11/25

[52] U.S. Cl. ..... 24/636; 24/230 AP; 24/230 A; 24/664

[58] Field of Search .... 24/230 AK, 230 AS, 230 AP, 24/230 TC, 230 A, 230 R, 230 AL

[56] References Cited

U.S. PATENT DOCUMENTS

| | | | |
|---|---|---|---|
| 4,004,115 | 1/1977 | Esner | 24/230 AL |
| 4,094,046 | 6/1978 | Takada | 24/230 AR |
| 4,136,425 | 1/1979 | Esner | 24/230 A |
| 4,137,611 | 2/1979 | Lindblad | 24/230 AL |
| 4,182,008 | 1/1980 | Pouget | 24/230 A |
| 4,237,586 | 12/1980 | Morinaga | 24/230 A |
| 4,310,952 | 1/1982 | Robben et al. | 24/230 A |
| 4,310,954 | 1/1982 | Lewis et al. | 24/230 A |

*Primary Examiner*—Robert A. Hafer
*Assistant Examiner*—Paul S. Polakowski
*Attorney, Agent, or Firm*—Roger H. Criss; Roy H. Massengill

[57] ABSTRACT

A locking element or latch is embodied from a metal plate and comprises a first pair of articulation tabs, a second pair of tabs to receive strains, these tabs being received in corresponding openings formed in the flanges of the base. The retaining member of the latch is guided in displacement in an L-shaped cutout and is associated with a floating contact with a rocker articulated on an ejector. A push button comprises engagement surfaces cooperating selectively with the locking member and ejector and ramps to assist the lifting of the latch. A single spring serves to actuate, and place under tension, all of the moving parts of the buckle.

9 Claims, 6 Drawing Figures

SEAT BELT BUCKLE WITH PIVOTING LATCH

DESCRIPTION

BACKGROUND OF THE INVENTION

The present invention relates to closure buckles for a safety belt system, especially for automobile vehicles, and more particularly a closure buckle of the type comprising a tilting bolt or latch locking member, and a retaining member for the locking element with the latch in locked configuration.

Such a buckle is the subject, for example, of French patent application No. 78/34404 that describes an arrangement utilizing, in a U-shaped base, a retaining member in the form of a bar urged by a spring, an ejector, also urged by a spring, and a locking element or solid and rigid latch formed on either side, with numerous projecting parts, the whole resulting finally in a heavy and somewhat bulky buckle that is relatively expensive to manufacture and assemble. There also was a proposal of a simplified buckle of this type, utilizing a locking element or latch, cut and shaped from a metal sheet, articulated at its rear end on a head of the rivet attaching it to the base of the metal strand connecting the buckle to an element of the vehicle chassis, as well as a retaining bar with angular displacement, fixed to a rocker which, in turn, is linked pivotally to an ejector guided to slide centrally in the base of the base, a return spring also coupling the push-button and the front end of the locking element.

The object of the present invention is an improved closure buckle of the type in question, simple in structure and inexpensive to manufacture, utilizing only a small number of elements and being characterized by compactness and lightness, while insuring a dependable locking of the latch.

Another object of the present invention is a proposal of a closure buckle insuring, with a reduced number of active elements, improved sequences of locking and opening of the buckle.

SUMMARY OF THE INVENTION

In accordance with this invention, there is provided a closure buckle for a safety belt system comprising a base defining a path of introduction for a tongue having at least one latch aperture;

a latch locking element, arranged to tilt vertically in the base around its rear part and having at its front part at least one projecting catch capable of cooperating with the latch aperture of the tongue, in a locked configuration;

an ejector slidably displaceable in the base in the path of the tongue;

a retaining member for the locking element in the locked configuration, displaceable between a first position of retention of the locking element and a second position of release;

an elastic means acting to urge the retaining member toward its first position; and a push button having first means of engagement capable of cooperating, when the push button is depressed, with the retaining member to displace it from its first position toward its second position;

characterized in that the push button comprises a second means of engagement having ramps capable of cooperating, when the push button is depressed, with the front part of the locking element and assisting to lift the latter after the first means of engagement has begun to displace the retaining member from its first position.

Preferably, the locking element is embodied by cutting and shaping of a metal plate and has, in its front part, aside from the projecting catch or catcher flange, surfaces cooperating with the second means of engagement, forming ramps of the push button, and, in its rear part, two pairs of tabs received in first and second parts, formed facing one another in the flanges of the base, one of these pairs of tabs serving as an articulation support of the locking element in the base, the other pair of tabs being capable of cooperating selectively, by elastic deformation of the material of the plate, with the edges of the corresponding ports at the time of the application of a heavy load on the buckle, by means of the latch catch.

DESCRIPTION OF THE PREFERRED EMBODIMENTS

Figure 1:
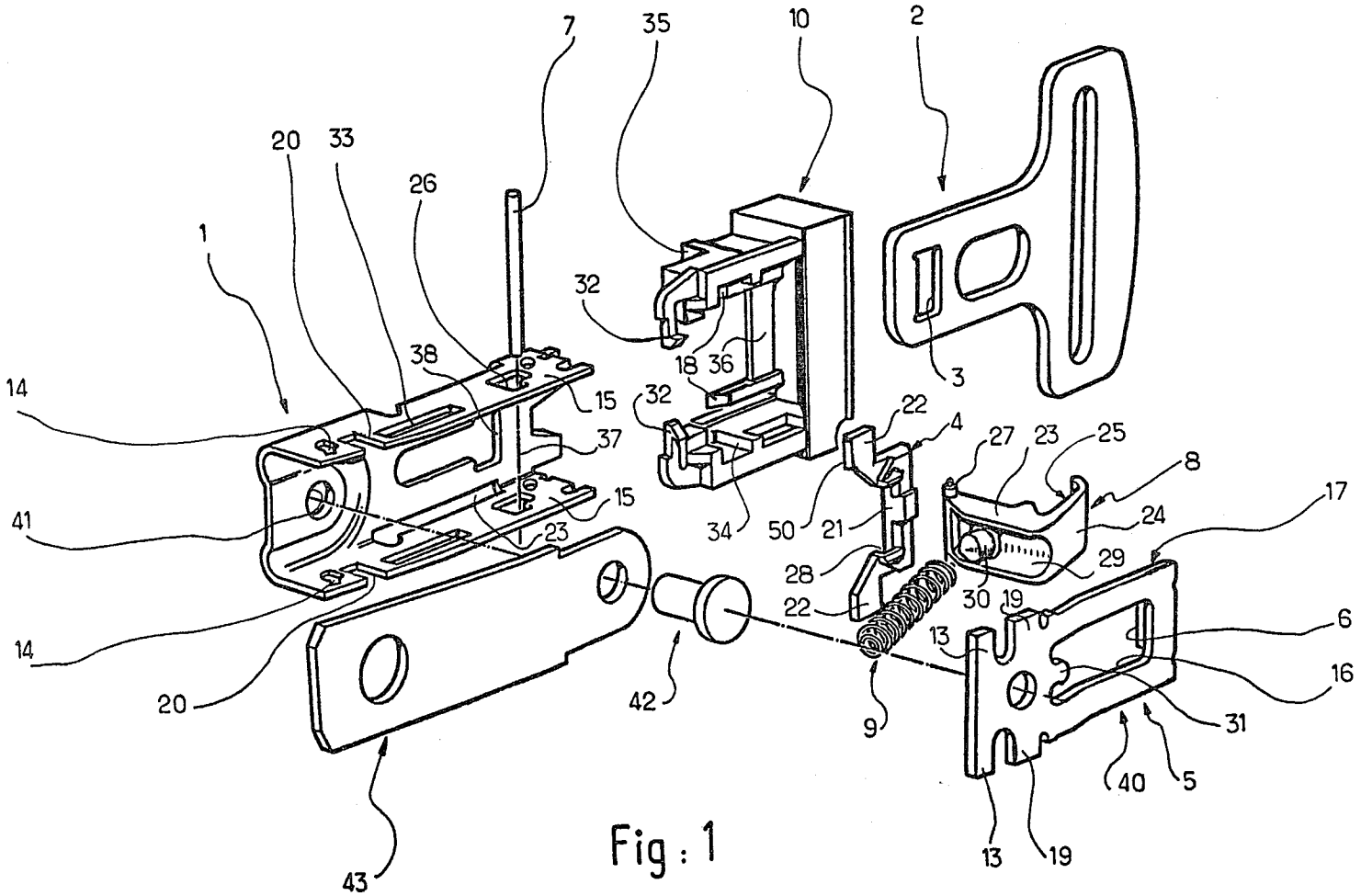
FIG. 1 is an exploded view of a buckle according to the invention (without enclosure elements).
Figure 2:
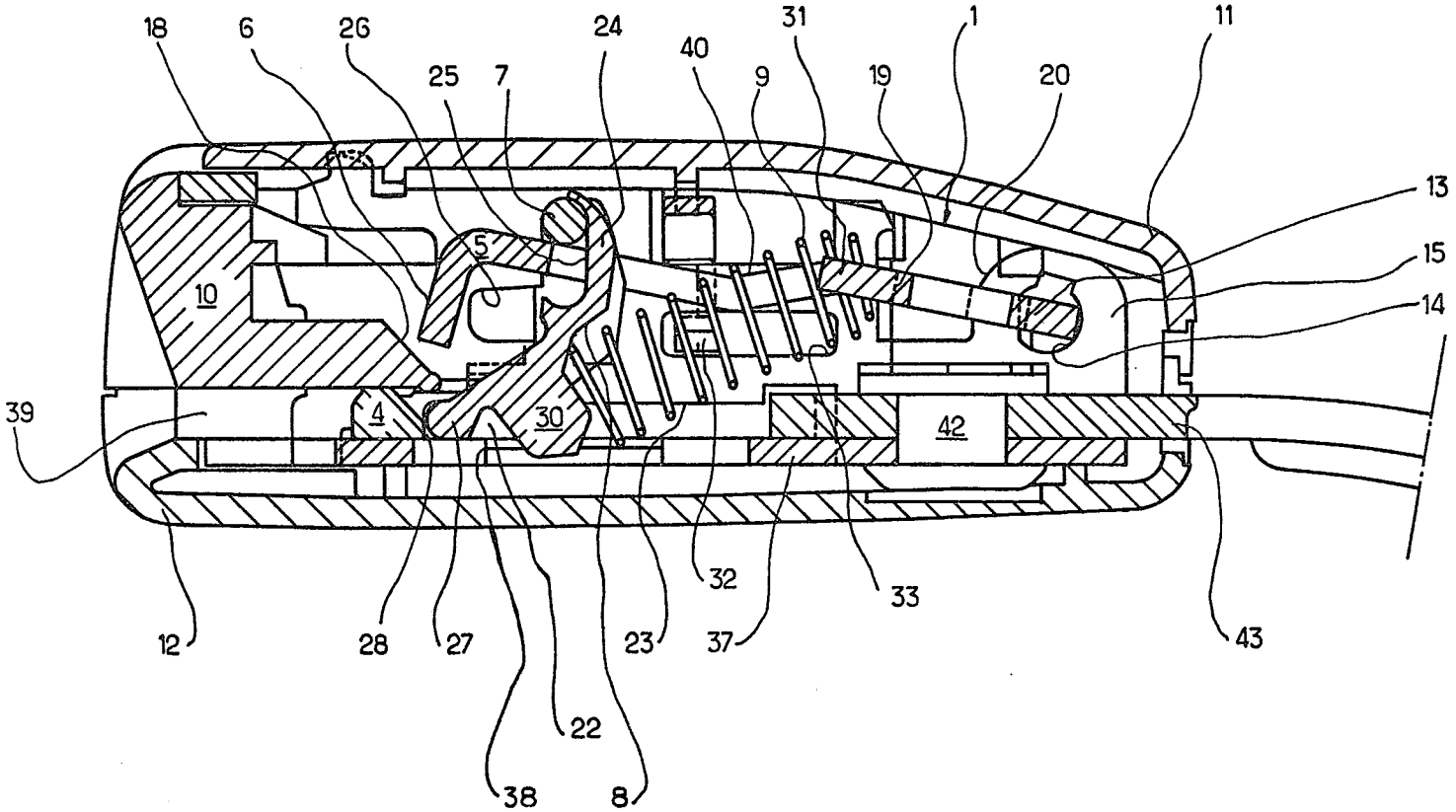
FIG. 2 is a longitudinal section view of the buckle in FIG. 1, with its enclosure elements.
Figure 3:
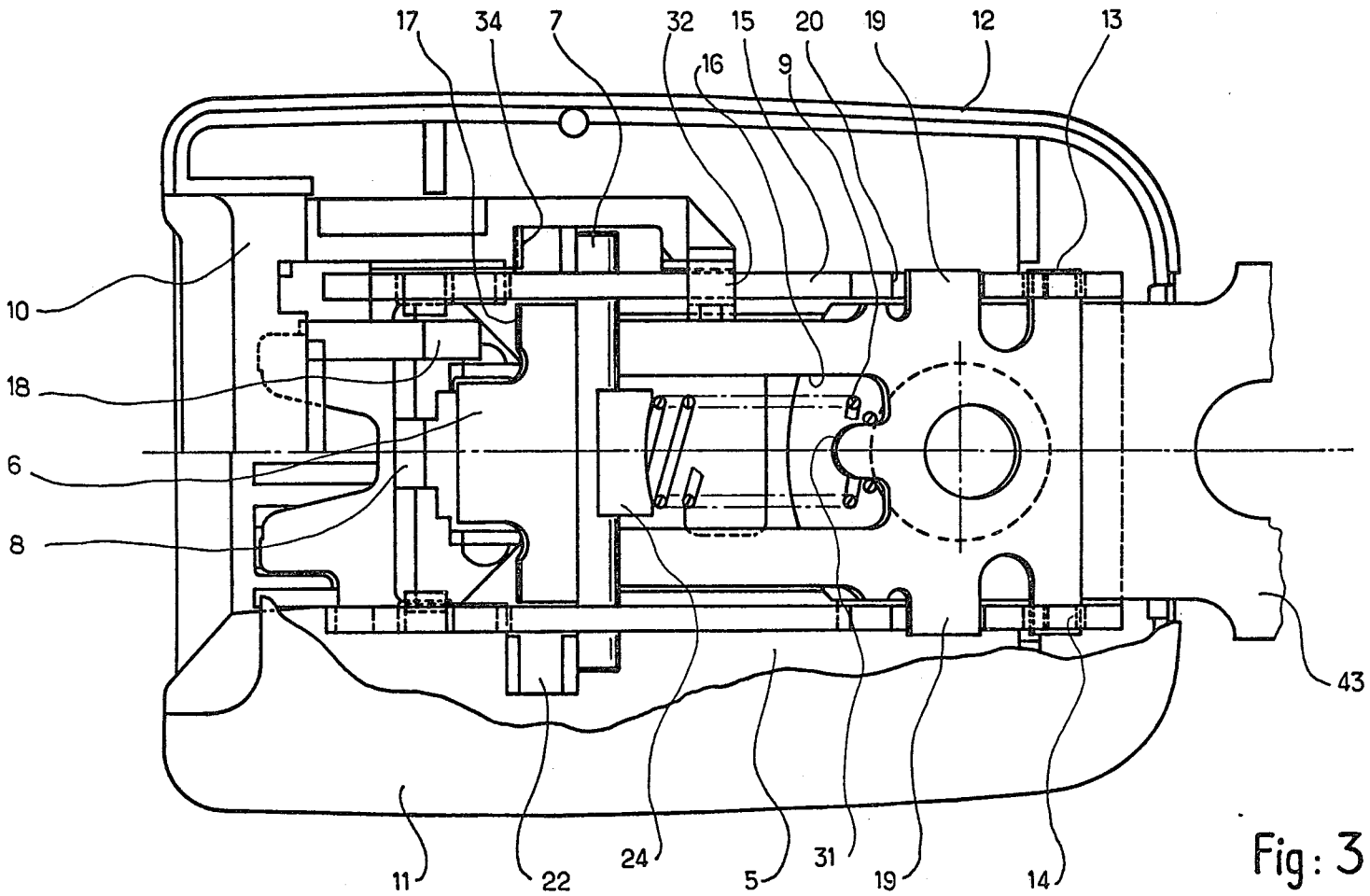
FIG. 3 is a plan view, partly cut away, of the buckle in FIG. 2.

As represented in the drawings, the buckle according to the invention comprises, essentially, a base 1 in the form of a U, advantageously made by cutting and shaping of a metal plate, defining a path of introduction 39 for a tongue 2 provided with a latch aperture 3, a latch ejector 4, a tilting locking element or latch 5 comprising, at its front, a projecting catch 6 to be received in cooperation in the latch aperture 3 in tongue 2 to lock the latter in the buckle, a retaining element 7 for locking element 5, appearing in the form of a section of a shaft or bar, a rocker 8 cooperating with retaining element 7 and ejector 4, a single compression spring 9 cooperating with locking element 5 and rocker 8, as well as a release push button 10. The buckle structure and mechanism according to the invention therefore comprise only seven elements. Of course, as represented in FIG. 2, the buckle assembly is completed by an upper covering element 11 and by a lower covering element 12.

In more specific fashion, according to the invention, locking element 5 includes, at its rear, two lateral tabs 13 received in profiled journaling cutouts 14 formed in the rear part of flanges 15 of base 1, thereby forming a pivot of articulation for locking element 5 in its vertical tilting movement in base 1. In the description and in the claims, expressions such as "front", "rear", "vertical" or "upward", refer to an orientation of the buckle according to FIG. 2, the front part corresponding to the end for introduction of tongue 2. Locking element 5 also has a central opening 16 for passage of rocker 8, and, at its front end, on either side of the bent end forming projecting catch 6, two lateral surfaces 17 forming zones of contact for the second means of engagement forming ramps 18 of the push button 10, as is discussed below. Locking element 5 also includes, in front of the first pair of articulation tabs 13, a second pair of lateral tabs 19 received loosely in profiled cutouts 20, opening upward, formed opposite one another in the flanges 15 of base 1.

The ejector 4, made of plastic, for example of polyamide, comprises a transverse body part 21 having a front face of contact with the end of tongue 2 and prolonged to the rear and laterally by two wings 22 received in longitudinal guide slots 23 formed at least partially in the lower part of flanges 15 of base 1. Wings 22 of the ejector can each have at least one beveled transverse edge 50 to actuate an electric switch integrated in the buckle, as required by certain laws. Rocker 8, also made of plastic, for example of polyamide, has a generally bent configuration with a main body part 23, prolonged angularly by an upper wing 24 defining an internal, non-enveloping face 25, cooperating by contact with retaining member 7. The latter, made in the form of a straight bar of quenched steel covered with a lubricant coating, has its lateral ends held and guided in cutouts 26, substantially in the form of an L, made opposite one another in the flanges 15 of base 1. Retaining bar 7 thus can be displaced longitudinally, then vertically, or vice-versa, as will be seen below, particularly in relation to FIGS. 4 to 6. Rocker 8 comprises, at the lower end of its body portion 23, projections forming lateral axis elements 27, received pivotally in recesses forming bearings 28 provided at the level of the connection between the body part 21 and the wings 22 of ejector 4. The rear face of body part 23 of rocker 8 is hollowed to offer a substantially semi-cylindrical hollow surface 29 corresponding to the cylindrical external profile of spring 9, with, in addition, above the axis of articulation of axis elements 27, a tapered cylindrical protuberance 30 shaped to correspond substantially with the cylindrical internal profile of spring 9. The latter is held between the rear face of body part 23 of rocker 8, and a central projection 31 formed in the rear of cutout 16 in locking element 5.

Figure 6:
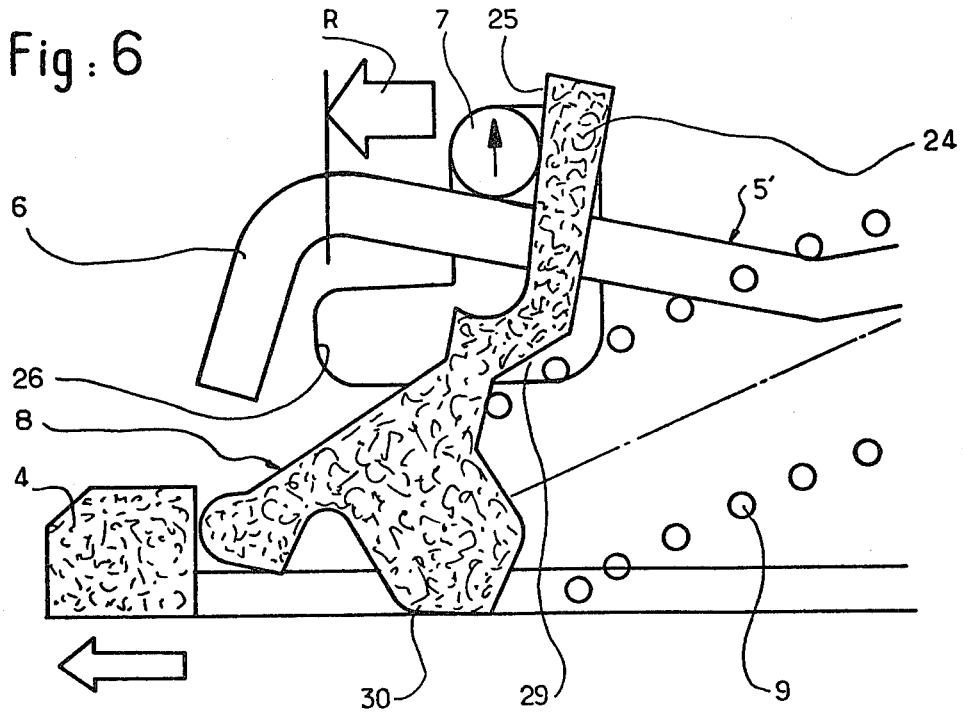

Push button 10, typically made of plastic, comprises, at its rear end, two mounting and guidance tabs 32 received in longitudinal slots 33 in flanges 15 of base 1, and, in extension longitudinally to the rear from the head portion, two parallel elongate longitudinal elements whose ends are bevelled to form ramps 18 arranged to cooperate, as push button 10 is depressed, with the lateral contact surfaces 17 of locking element 5, and thereby assist the latter to rise or to tilt after retaining member 7 has been previously repelled to the rear by internal engagement surfaces 34 of push button 10. The latter also comprises, on its external lateral faces, two other engagement surfaces 35 that can cooperate with the front edges of the lateral tabs 22 of ejector 4. The general structure of push button 10, which is U-shaped in plan, is partly closed centrally by a web 36 serving as a guide for the end of tongue 2 as it is introduced into the buckle. The bottom 37 of base 1 has a central cutout 38 in the form of a T to receive, on the one hand, at its front end the projecting catch 6 of locking element 5 in the locked configuration of tongue 2, and on the other hand the cylindrical protuberance 30 of rocker 8 in the unlocked buckle configuration (FIGS. 2 and 6).

Operation of the buckle is as follows. In normal configuration or repose or in the unlocked state (FIGS. 2 and 6), retaining bar 7 occupies its second position of release at the top of the vertical arm of the L of cutout 26, spring 9 being slightly compressed in a substantially straight condition, between the rear part of opening 16 in locking element 5, and the upper lateral perimeter of protuberance 30 of rocker 8 in rear, inclined position, i.e. with ejector 4, to which it is linked in articulated fashion, in extreme forward position in the path of introduction of the tongue. In this configuration, under the influence exclusively of the force of spring 9 urging ejector 4 toward its extreme forward position, the lateral tabs 22 of ejector 4, by contact against engagement faces 35, keep push button 10 stable, in configuration of repose, partly protruding.

Then, if tongue 2 is inserted into the path of introduction 39, the end of the tongue will come in contact with ejector 4 and repel the latter to the rear, together with the lower part of rocker 8, against the force of spring 9, causing contact surface 25 of upper arm 24 of the rocker to slide relative to retaining bar 7, until body part 23 of rocker 8 moves beyond the point of contact between pressure surface 25 and retaining bar 7, with proturberance 30 starting to become engaged in the adjacent end of spring 9. Beyond this point, owing to the further displacement of ejector 4, a "flattening" torque acts on rocker 8 tending to urge bar 7 downward until, as it moves along the forward ridge of the vertical wing of cutout 26, it comes flush with the horizontal wing of this cutout, toward the forward end of which it is immediately precipitated by abrupt tilting of rocker 8, which, owing to the curbing, in this configuration, of the end of spring 9 on protuberance 30, results in a marked upward curvature of the spring keeping the pressure surface 25 of the rocker pressed against bar 7 and cooperating with the latter to force and hold retaining element 5 in the lower tilted position with its projecting catch 6 received in latch aperture 3 of the tongue, and partially in cutout 38 of the bottom of the base (locking configuration in FIG. 4). In this configuration, the spring, by means of the tilting of the lateral ends of retaining bar 7 bearing against engagement surfaces 34 of push button 10, holds the latter in stable, projecting position.

Figure 4:
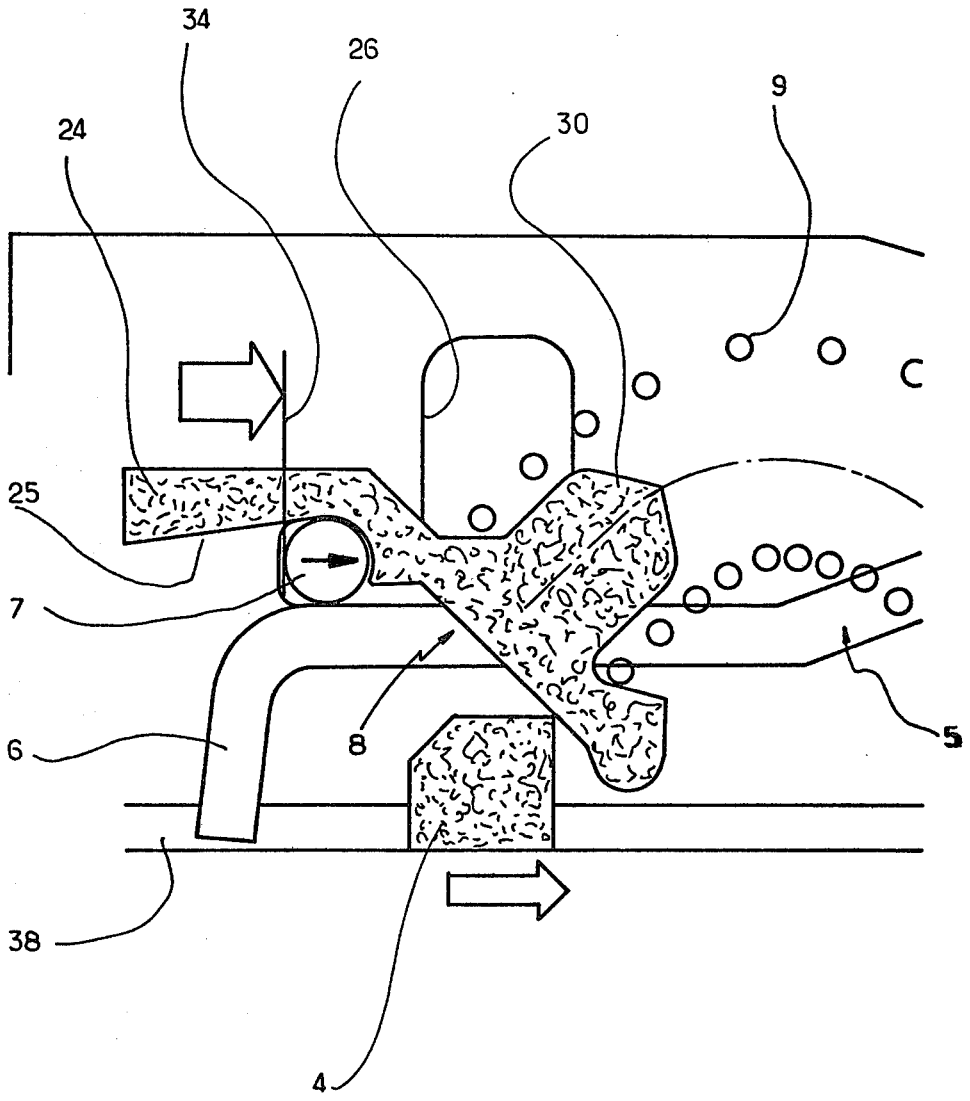
FIGS. 4 to 6 illustrate the kinematics of activation of the locking element and the retaining member thereof.
Figure 5:
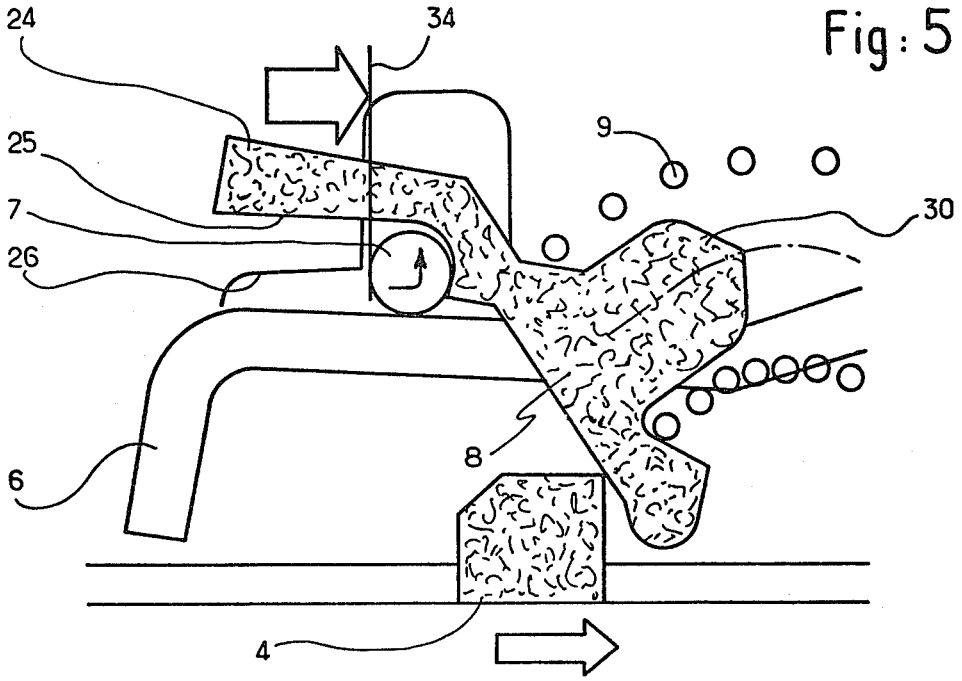

If, from this locked position, a movement to depress push button 10 is then begun, the engagement faces 34 immediately start to move retaining bar 7 to the rear, as indicated by arrows in FIG. 4, producing a further compression of spring 9 and once more causing a rearward movement of rocker 8 and ejector 4 in combination. Shortly before bar 7 reaches the angle between the horizontal and vertical wings of cutout 26, the oblique ramp surfaces 18 of push button 10 begin to cooperate, in a lifting pressure, with contact surfaces 17 of locking element 5. When retaining bar 7 has reached the position represented in FIG. 5, the forces resulting from the pressure of bar 7 on the upper tab 24 of rocker 8 and from the force of compression of spring 9, initiate a forward tilting of rocker 8, allowed by the return of ejector 4 in contact against the front end of the tongue. By an abrupt action, retaining bar 7 is returned upward in the configuration in FIG. 6, with continuation of the rise of locking element 5 and complete tilting of rocker 8 toward its configuration in FIG. 6, abruptly pushing ejector 4 forward to eject the tongue from the buckle under the influence exclusively of spring 9, and, under the thrust of the tabs, as indicated by arrow R, automatically returning the push button to its normal undepressed position of repose.

Study of the above kinematic steps will reveal the floating cooperation of spring 9 relative to rocker 8, making it possible to dispense with the arrangement of a spring centering tube at the level of projection 31, as well as the floating cooperation between retaining bar 7 and the upper arm 24 of rocker 8, making it possible to reduce the overall height of rocker 8, and hence of the buckle, while, in addition, insuring a maximum forward stroke of ejector 4 (the latter then having a very extensive longitudinal stroke, which is necessary, for example, when the specifications call for a supplementary penetration stroke of the tongue into the buckle). It will also be noted that a single spring serves to actuate, and place under tension, all the active elements of the buckle.

According to a particular aspect of the invention, when the buckle is in latch-locked configuration, projecting catch 6 is received at least partially in the front end of opening 38 (FIG. 4), a short distance from the front edge of this opening 38 (otherwise the tilting movement of the locking element would be hampered). In this configuration, the front edge of the second tabs 19 of locking element 5 is likewise at a short distance from the adjacent edges of cutouts 20 in the flanges 15 of the base. It will also be noted that locking element 5, at the front of these second tabs 19, exhibits a slight camber or fold at the level of zone 40. If, for example, in the event of a difficult condition or an accident, a strong force is exerted on tongue 2, and consequently on locking element 5, the projecting catch 6 will bend elastically forward and immediately bear against the front edge of opening 38 and, subsequently or concomitantly, depending on the magnitude of the force, tabs 19 will in turn bear, again by elastic deformation, against the front edges of cutouts 20, although tabs 13 will not actually participate in taking up this strain. This assembly therefore makes it possible to dispense with the direct connection between locking element 5 and the connection and stress take-up member of the buckle. When the strong force ceases, the projecting catch 6 and tabs 19 return elastically to their position slightly distant from the adjacent zones of the base. As a result, the base can be fitted either with a hole 41 for passage of a single rivet with head 42 to integrate it with a traction plate 43, or to a metal braid, or, in place of hole 41, with a transverse slot for passage of a connecting belt, for example for safety belt buckles for the rear seat of the vehicle.

The buckle can therefore be embodied in simple fashion, from standard (metal and plastic) materials, requiring no special surface coatings, while insuring locking safety and an absence of clicking in both locked and unlocked configurations. The complete weight of the buckle structure can therefore be reduced to far below 100 grams, while at the same time, by reason of the small number and the simplicity of the parts, making it possible to reduce the time and the cost of assembly.

We claim:

1. Closure buckle for safety belt system comprising:

a U shaped metal base defining a path of introduction for a tongue having at least one latch aperture and a pair of lateral upstanding flanges;

a latch locking element, arranged to tilt vertically in said base around its rear part and having at its front part at least one projecting catch capable of cooperating with said latch aperture of the tongue, in a locked configuration;

an ejector slidably displaced in said base in the path of the tongue;

a retaining member for locking said locking element in the locked position, said retaining member displaceable between a first position of retention of said locking element and a second position of release vertically offset from said first position;

a rocker member having a base pivotally linked to said ejector and an upper tab in floatable contact with said retaining member, said rocker member tiltable between a first position with said ejector in its forward most position and the upper tab of said rocker member in a vertical position allowing said retaining member to be displaced to said second position, and a second position with said ejector in its rearward most position and the upper tab of said rocker member in a horizontal position locking said retaining member in said first position;

an elastic means acting on said rocker member, said elastic means producing a first force urging said rocker member towards its first position displacing said ejector forward and producing a second force urging said rocker member towards its second position displacing said retaining member to said first position;

a push button having first means of engagement operative to displace said retaining member from its first position towards its second position, when the push button is depressed;

and second means of engagement having ramps capable of cooperating with the front part of said locking element and assisting to vertically lift said locking element from said latch aperture and lift said retaining member to its second position after the first means of engagement has displaced the retaining member from its first position, the displacement of said retaining member to said second position tilting said rocker member sufficiently to permit said elastic means to produce said first force urging said rocker member to its first position.

2. Buckle according to claim 1, characterized in that said locking element is a metal plate, said locking element being supported pivotally in said base by a first pair of tabs formed at its rear end and received in first profiled ports formed in said flanges, and said locking element having, in front of the first pair of tabs, a second pair of tabs received loosely in second profiled ports formed in said flanges.

3. Buckle according to claim 2, characterized in that said second ports are formed so that, in the absence of a load applied on said locking element, the front edges of said tabs in the second pair do not bear against the adjacent edges of said second ports, and that said base includes an opening adapted to receive said projecting catch.

4. Buckle according to claim 1, characterized in that said retaining member is constituted by a bar, displaceable between said first and second positions, offset longitudinally and vertically from one another, and is guided by its lateral ends in shaped cutouts formed in the flanges of said base.

5. Buckle according to claim 4, characterized in that said elastic means is constituted by a compression spring whose rear end presses on the rear part of said locking element, and whose front end presses against said rocker member.

6. Buckle according to claim 5, characterized in that the front end of said spring cooperates under floating pressure with said rocker member, which has, on its rear face a profiled protuberance selectively engageable in the front end of said spring.

7. Buckle according to claim 1, characterized in that said ejector comprises two lateral guidance wings received in elongate ports formed in the flanges of said base.

8. Buckle according to claim 7, characterized in that said push button comprises a second means of engagement capable of cooperating with the lateral wings of said ejector to return said push button to its unpushed position with said ejector in said first position.

9. Buckle according to claim 1, characterized in that the bottom of said base comprises, in its rear part, means for mounting the buckle.

* * * * *